United States Patent [19]

Lundy

[11] 4,106,631

[45] Aug. 15, 1978

[54] FLY AND JIB ASSEMBLY FOR CRANE

[75] Inventor: Richard W. Lundy, Rothschild, Wis.

[73] Assignee: J. I. Case Company, Racine, Wis.

[21] Appl. No.: 769,933

[22] Filed: Feb. 18, 1977

[51] Int. Cl.[2] ..... B66C 23/06

[52] U.S. Cl. ..... 212/144; 212/59 R

[58] Field of Search ..... 212/144, 55, 59 R; 182/210, 211; 52/114, 116

[56] References Cited

U.S. PATENT DOCUMENTS

| | | | |
|---|---|---|---|
| 3,085,695 | 4/1963 | Miller | 212/144 |
| 3,125,227 | 3/1964 | Kauffman et al. | 212/144 |
| 3,149,730 | 9/1964 | Mork | 212/144 |
| 3,464,570 | 9/1969 | Mork | 212/144 |
| 3,620,379 | 11/1971 | Fauchere | 212/144 |
| 3,968,884 | 7/1976 | Johnson et al. | 212/55 |

*Primary Examiner*—Lawrence J. Oresky
*Attorney, Agent, or Firm*—Dressler, Goldsmith, Clement, Gordon & Shore, Ltd.

[57] ABSTRACT

A multisection crane boom having a fly and jib assembly attachable thereto is disclosed herein. The fly section and jib section of the assembly are pivotally interconnected at adjacent ends through a freely pivoted link so that the jib section can be pivoted from the stored position extending generally parallel and below the fly section to a usable position wherein the longitudinal axes of the two sections are aligned with each other or coincident at the interconnected ends. Cable means are utilized for holding the jib section in an extended position on the fly section and the cable means are capable of having the jib in end-to-end or angular relation with respect to the fly section. The fly section also has a lug thereon which prevents attachment of the cable means when the fly section is at an angular position with respect to the main boom. The fly section is connected to the boom in a unique fashion which eliminates the need for cables to hold the fly section in a plurality of positions.

12 Claims, 8 Drawing Figures

Fig. 1.
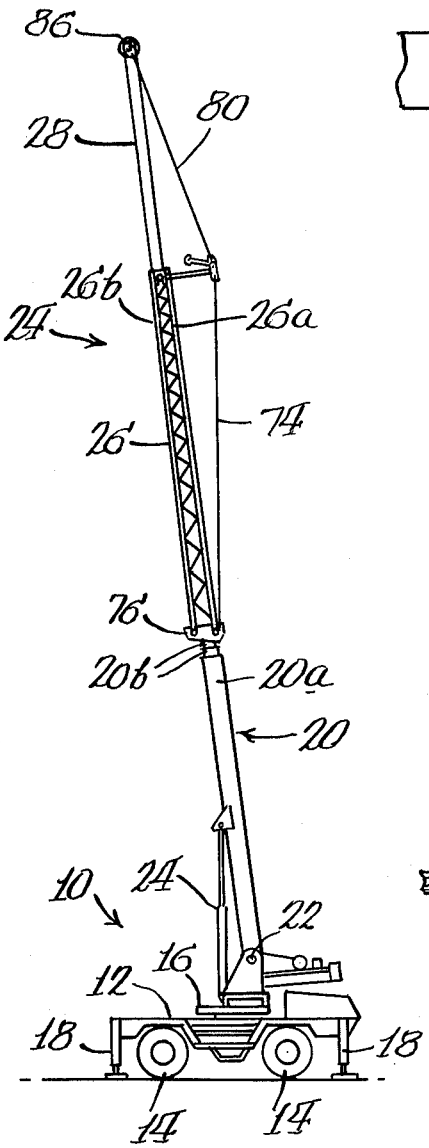
Fig. 3.
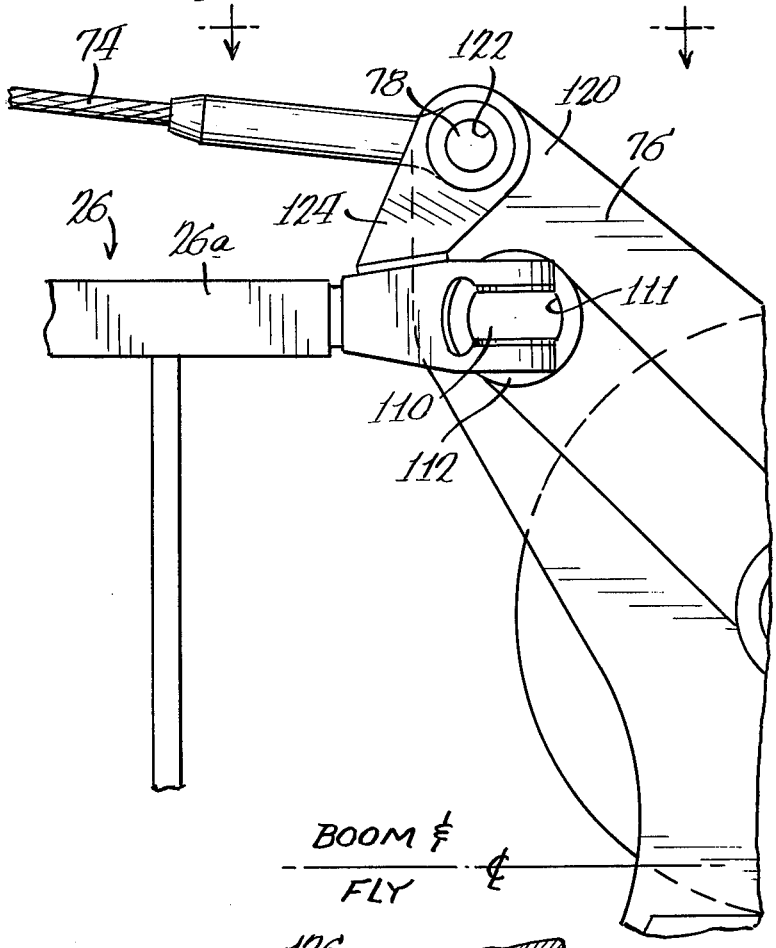
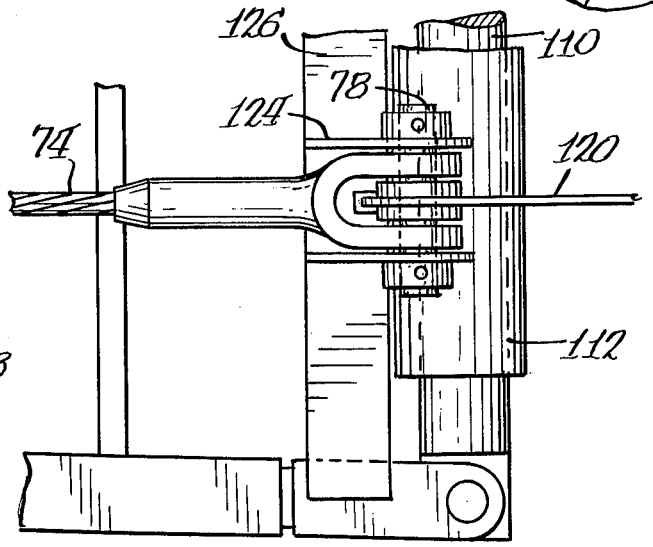
Fig. 4.

122
120
128
124
110
112
111
26
26a
76
BOOM
FLY
26b
116
118
114
26a

FLY AND JIB ASSEMBLY FOR CRANE

BACKGROUND OF THE INVENTION

In crane boom assemblies, particularly those having extensible booms, it has become customary to provide an extension which is adapted to be mounted on the outer end of the boom to provide additional length thereby increasing the versatility of the crane. The extension is supported on the end of the boom by cables and can be held at different angular positions by using different cables or cable extensions. An example of an auxiliary or extension boom is disclosed in Forsythe et al. U.S. Pat No. 1,920,370. The extension disclosed in the Forsythe et al. patent is the type which must be manually removed from the boom when the extension is not required. This type of arrangement normally requires a separate vehicle for transporting the extension and also is time consuming to erect and remove from the crane boom.

Thus, proposals have been made for supporting the extension directly on the boom when the extension is not needed. Examples of this type of extension are disclosed in Grove U.S. Pat. No. 3,366,250; Lamer et al. U.S. Pat. No. 3,698,569; and Lamer U.S. Pat. No. 3,732,988.

In order to further increase the versatility of cranes of this type, it has more recently been proposed to adapt the unit so that a fly section may be attached to the outer end of the boom and may either be positioned in end-to-end relation with the boom and/or at various offset angles with respect to the main boom. In addition, additional length for the boom is provided by attaching a jib section on the outer end of the fly section.

Present known designs of fly section and jib section combinations allow the jib to be stored under the fly section when not in use. In order to rotate the jib section to a stored position on the fly section, it had been necessary to mount the jib section below the center line of the fly section. This means that when the jib section is moved to a usable position the center line of the jib section is offset from the center line of the fly section which results in undesirable bending stresses in the fly section when loads are placed on the jib section.

As indicated above, the jib section is normally adapted to be attached to the outer end of the fly section at a plurality of angular positions while the fly section is adapted to be attached to the boom in a plurality of angular positions to further increase the versatility of the entire unit. It has been determined that allowing the fly section to be angularly offset with respect to the boom section when the jib section is in a usable position will cause excessive bendng stresses on the main boom. This may also present a safety hazard since the end of the fly section is offset from the main boom sufficiently and may result in tipping of the crane when loads are supported thereon.

SUMMARY OF THE INVENTION

According to the present invention, a fly and jib assembly is designed so that the jib can be stored under and generally parallel to the fly section when the jib section is not needed. The jib and fly section are interconnected in such a manner that the longitudinal center lines of the respective sections are coincident to each other when the two sections are in an end-to-end usable position.

More specifically, the adjacent ends of the fly section and jib section are pivotally interconnected by freely pivoted link means that defines a pivot axis for the jib section with respect to the fly section. The pivot axis for the jib section is spaced from the longitudinal axes of each of the respective sections by an equal amount so that the longitudinal axes are coincident when the jib section is moved to a fully end-to-end position with respect to the fly section. In the illustrative embodiment, the linkage means includes a pair of freely pivoted links that are pivotally supported on the longitudinal axis for the fly section and have opposite free ends pivotally supported on the jib section at a location which is spaced from the longitudinal axis for the jib section.

According to another aspect of the invention, the jib section is supported on the fly section by cable means that has one end connected to a free end of the jib section and an opposite end connected to the end of the main boom. The assembly incorporates means for preventing connection of the cable to the end of the main boom when the longitudinal axis of the fly section is angularly related to the longitudinal axis of the main boom.

In the illustrative embodiment, the means preventing connection includes a lug on the fly section that obstructs an opening on the extension section which receives a pin for connecting the cable means to the extension section of the boom.

According to a further aspect of the invention, the fly section is connected to the boom without the use of cables, and can still be held in a plurality of angular positions on the boom. This connection includes a mounting head that has a first opening for receiving a pin which supports the upper portion of the fly section. The mounting head has a plurality of second openings that are located on a common radius with respect to the upper or first opening. Each of the lower openings is capable of receiving a pin to support the lower portion of the fly on the boom in different positions on the boom.

BRIEF DESCRIPTION OF THE SEVERAL VIEWS OF THE DRAWINGS

FIG. 1 shows a crane boom having a fly and jib assembly constructed in accordance with the present invention supported thereon;

FIG. 3 is a fragmentary view similar to FIG. 2 showing the fly section in direct end-to-end relation on the main boom;

FIG. 4 is a fragmentary plan view as viewed along line 4—4 of FIG. 3;

DETAILED DESCRIPTION

Figure 2:
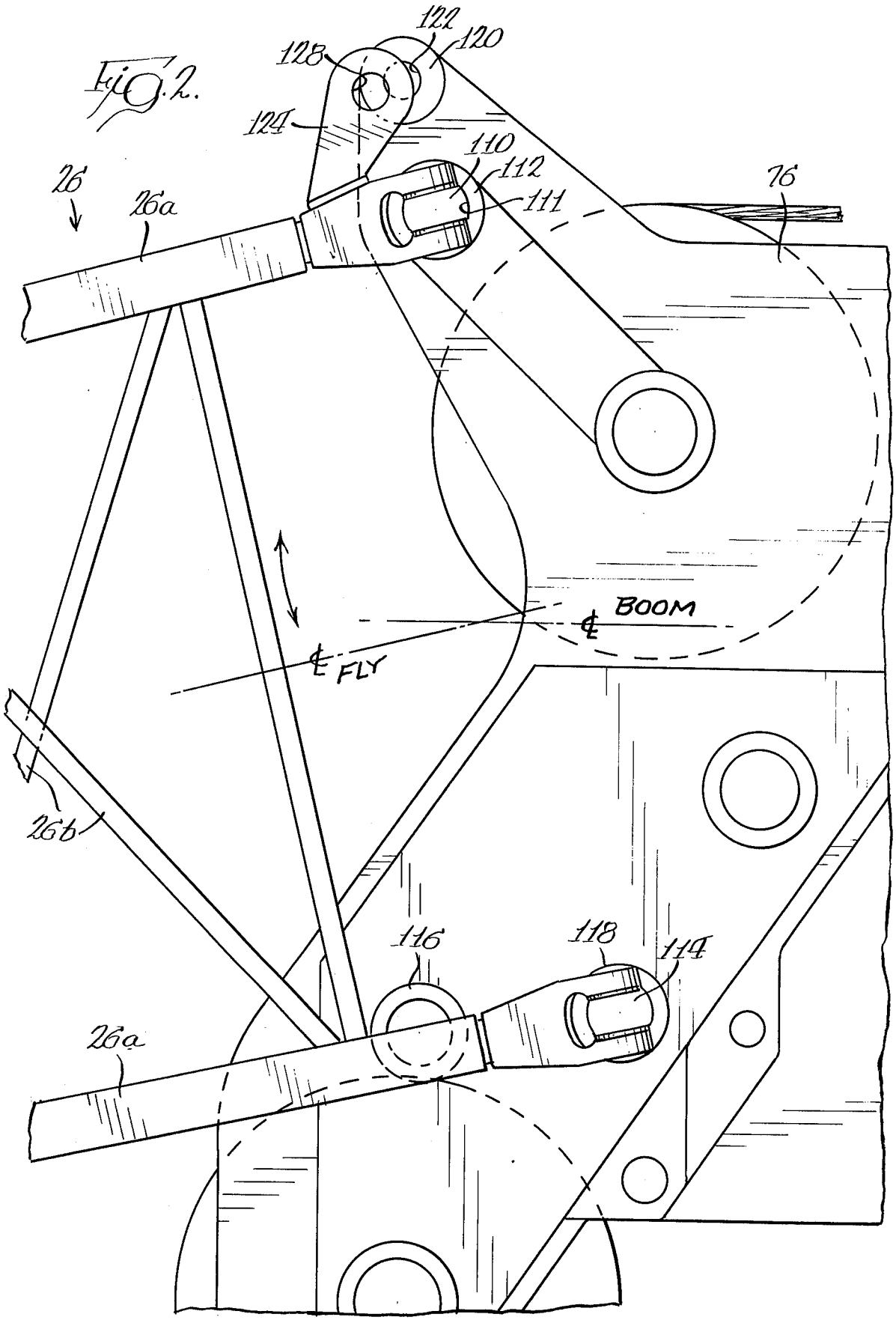
FIG. 2 is an enlarged fragmentary side view showing the interconnection between the main boom and the fly section.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

Referring to FIG. 1 of the drawings, there is shown a mobile crane generally indicated by the reference numeral 10. Mobile crane 10 consists of a frame structure 12 supported on a plurality of wheels 14 with a turntable 16 rotatably supported on frame structure 12. Frame structure 12 may have a plurality of outriggers 18 so that wheels 14 may be raised off the ground to increase the stability of the frame.

A multisection crane boom 20 is pivotally supported at 22 on turntable 16 and is pivoted thereon by a fluid ram 24. The multisection main boom 20 includes an inner boom section 20*a* pivotally supported on pin 22 and at least one extension section 20*b* mounted for telescoping movement relative to inner boom section 20*a* through a fluid ram (not shown).

According to the present invention, a fly and jib assembly 24 is mounted on the outer end of the outermost extension section 20*b*. The fly and jib assembly consists of a fly section 26 which is adapted to be connected to the outer end of extension section 20*b* in a plurality of positions. Jib and fly assembly 24 also includes a jib section 28 which is permanently mounted on the outer end of fly section 26 and is capable of being held in a plurality of positions with respect to the longitudinal axis of the fly section, as will be explained later.

Fly section 26 may be constructed in various shapes and has been illustrated as a lattice construction including four corner members 26*a* interconnected by brace members 26*b*. Likewise, jib section 28 has been illustrated as consisting of two spaced beams 28*a* (only one being shown) interconnected by cross braces (not shown).

According to one aspect of the present invention, the outer end of the fly section and the inner end of the jib section are permanently interconnected and the connection is designed so that the jib section can readily be moved from a usable position to a stored position with minimum effort. In addition, when the jib section is in a usable position on the fly section, the longitudinal center axes of the two sections are coincident with each other when the sections are in end-to-end relation. When the jib section is in a stored position on the fly section, the respective axes extend generally parallel to each other and are vertically spaced from each other.

Figures 5, 6, 6A:
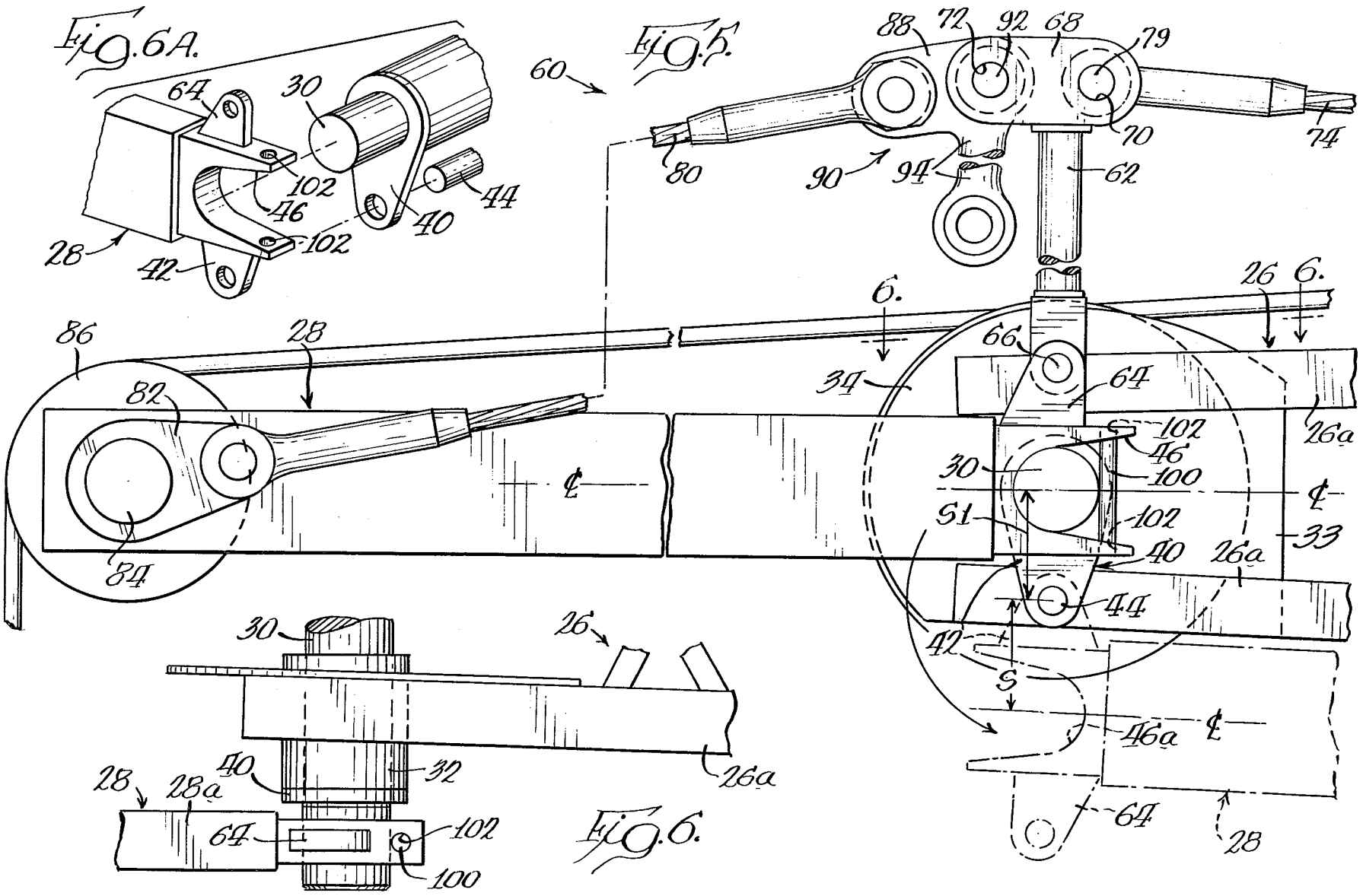
FIG. 5 is a fragmentary view of the adjacent ends of the fly section and jib section.
FIG. 6 is a fragmentary plan view as viewed along line 6—6 of FIG. 5.
FIG. 6A is a fragmentary exploded view of one of the two joints interconnecting the jib and fly sections.

As illustrated in FIGS. 5 and 6, the outer end of fly section 26 has a sheave supporting pin 30 supported in a pair of bearing sleeves 32 (only one being shown), which are respectively supported on plates 33 that extend between vertically spaced corner members 26*a* that define the fly section. A cable sheave 34 is rotatably supported on sheave pin 30. As most clearly shown in FIG. 5, the sheave supporting pin 30 is located on the longitudinal center line or axis for fly section 26.

The sole permanent connection between the adjacent ends of fly section 26 and jib section 28 consists of link means 40 consisting of first and second links (only one being shown) respectively interposed between the respective sides of the fly section and jib section. Link means or links 40 have one end freely pivoted on sheave pin 30 while the opposite ends are respectively supported on lugs 42 through connecting pins 44.

The inner ends of legs 28*a* defining jib section 28 are bifurcated to define substantially U-shaped recesses 46 and the base portion of each recess is arcuate and corresponds to the periphery of pin 30. The center of each arcuate base portion 46*a* of recess 46 is located on the longitudinal center line or axis for jib section 28. As clearly shown in FIG. 5, the spacing (S) between the center of arcuate base portion 46*a* of U-shaped recess 46 and the center of the opening in lug 42 is equal to the spacing (S1) between the openings in links 40 which receive the respective pins 30 and 44. Thus, when jib section 28 is moved from the stored position, illustrated in phantom line in FIG. 5, to a usable position in end-to-end relation with respect to fly section 26, the longitudinal center lines or axes of the respective sections are coincident with each other. This particular arrangement virtually eliminates any bending stresses from being developed in the jib section when the fly section is in a usable position.

According to another aspect of the invention, the fly and jib assembly also include cable means 60 for maintaining jib section 28 in an end-to-end usable position on the fly section. Since two sets of cables are utilized and are identical, only one will be described. Cable means 60 includes a strut 62 having a lower end pivotally supported on a lug 64 through a pin 66, and lug 64 is secured by welding to member 28*a*. The upper end of strut 62 has a bracket 68 secured thereto and the bracket has first and second openings 70 and 72. A first cable 74 of cable means 60 has one end (FIG. 3) connected to a mounting head 76 through a pin 78. The details of this connection will be described later. The opposite end of first cable 74 is connected to bracket 68 through a pin 79.

Cable means 60 also includes a second cable 80 which has one end connected to the free end of jib section 28 through a link 82 that is pivotally supported on a sheave pin 84 which supports a cable sheave 86 at the outer end of jib section 28. The opposite end of cable 80 is connected to a leg 88 of an L-shaped bracket 90 which is pivotally supported on bracket 68 through a pin 92. L-shaped bracket 90 also has a second leg 94 which is longer than the first leg.

Since cable means 60 is located above fly section 26 and jib section 28, the respective cables 74 and 80 will be in tension and will force the inner end or arcuate surface 46*a* into engagement with the periphery of pin 30 and, therefore, eliminate the need for any further additional connection between fly section 26 and jib section 28. However, if for safety reasons, an additional connection is required, this connection may be accomplished by utilizing pins 100 that extend through openings 102 in the respective legs which define recess 46.

Figure 8:
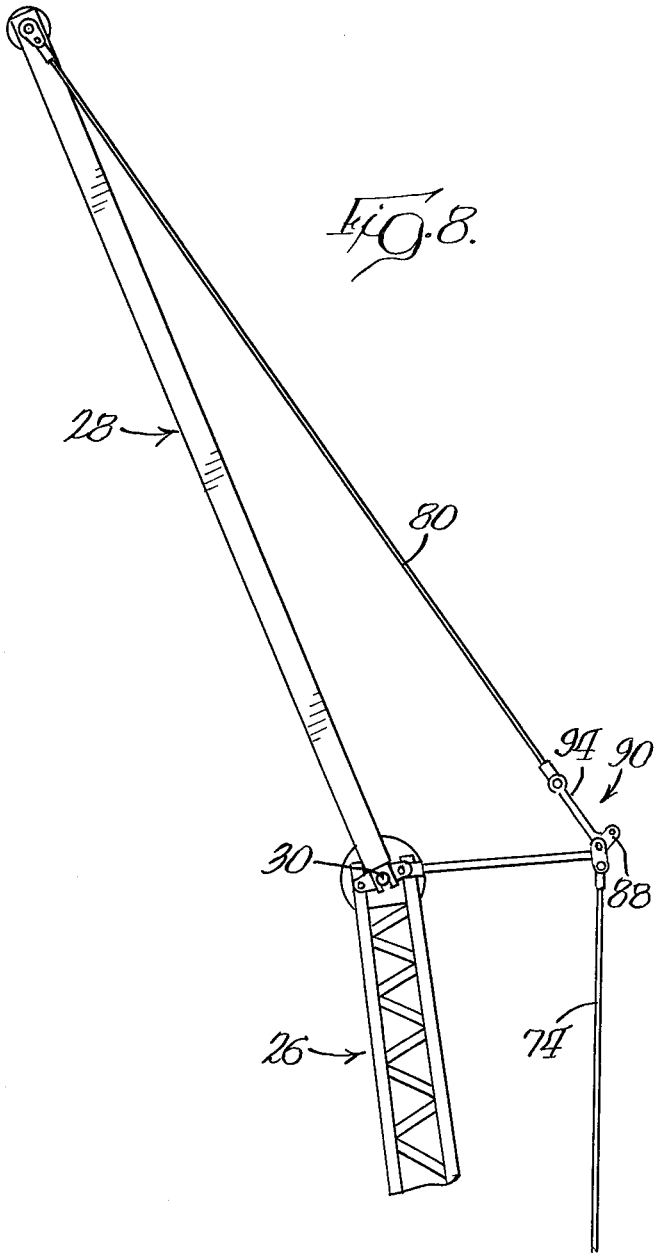
FIG. 8 is an enlarged fragmentary view similar to FIG. 1 showing the jib section in an angular usable position.

As indicated above, in some instances, it may be desirable to have the jib section 28 in an angularly related usable position with respect to the longitudinal axis of fly section 26. This can readily be accomplished by utilizing the same cable means 60 by a mere manipulation of L-shaped link 90. Referring to FIG. 5, if it is desired to have the jib section angularly related to the fly section, it is only necessary to disconnect cable 80 from leg 88 of L-shaped link 90 and reconnect cable 80 to the second leg 94. This angular usable position is shown in FIG. 8. Since the second leg 94 is substantially longer than the first leg 88, the jib section 28 will automatically be positioned in an angular usable position with respect to fly section 26 and this angle will be determined by the length of leg 94. Since links 40 are freely pivoted on sheave pin 30, links 40 will pivot with jib section 28 so that arcuate base portion 46*a* will remain in engagement with pin 40 in the angular usable position for jib section 28.

As indicated above, fly section 26 is capable of being supported in a plurality of angularly related positions with respect to boom 20. According to one aspect of the invention, this is accomplished without the need for any cables. The inner ends of the respective upper legs or corner members 26*a* are interconnected by a first pin 110 which extends through an opening 111 in a first sleeve 112 that is supported in a fixed relation on the upper end of mounting head 76. The lower corner members 26*a* of fly section 26 are also interconnected through a second pin 114. Mounting head 76 has two or more lower sleeves 116 and 118 that define second openings which have their centers located on a common radius with respect to the center of opening 111 in sleeve 112. For example, sleeve 116 can be positioned on head 76 so that the longitudinal center line or axis of fly section 26 is coincident with the longitudinal center line or axis of boom 20 so that the fly section is in an end-to-end relation on the outer end of boom 20. Sleeve 118 can be positioned to have these two longitudinal center lines angularly related to each other.

With this arrangement, the position of fly section 26 can readily be adjusted by removing pin 114 from a second opening and pivoting fly section 20 on pin 110 so that pin 114 can be inserted into another second opening.

When both jib section 28 and fly section 26 are in an extended usable position on the outer end of boom 20, a condition can readily occur wherein the sheave 86 on the outer end of jib section 28 is transversely offset with respect to a vertical rotational axis of turntable 16 beyond maximum limits which creates a hazardous condition. This is particularly feasible when jib section 28 is angularly related to fly section 26 and boom 20 is in a fully extended position. Since the respective sections are of substantial length, it has also been determined that if the fly section is angularly related with respect to the main boom when the jib is attached, excessive bending stresses are developed in the main boom when a load is supported on the outer end of the fly section. To eliminate this hazardous condition and further reduce the maximum bending stresses that can be developed in the boom, the crane structure of the present invention incorporates means for preventing the connection of cable means 60 to boom section or extension section 20*b* when fly section 26 is in any position other than in direct end-to-end relation with respect to main boom 20. This is again accompliahed in an extremely simple manner, as will now be described.

Referring to FIGS. 2 and 3, it will be noted that head 76 has an extension or lug 120 for each cable 74 and lug 120 has an opening 122 for receiving pin 78 to define a primary connection for attaching cable 74 thereto. The means for preventing connection of cable 74 to head 76 consists of a pair of lugs 124 that extend from a cross brace 126 on opposite sides of each lug 120 and lugs 124 have openings 128 that are substantially identical in size to openings 122. Thus, when fly section 26 is in direct end-to-end relation with respect to boom 20, wherein the center lines are coincident, openings 122 and 128 are aligned with each other so that pin 78 can be inserted therethrough to connect cable 74 to both the fly section and the extension section 20*b* of boom 20. However, if fly section 26 is angularly related to boom 20, as illustrated in FIG. 2, openings 122 and 128 are offset from each other to preclude insertion of pin 78 for connecting cable 74 thereto. Of course, it will be appreciated that the primary connection for cable 74 could be on fly section 26 and the means preventing connection could be on extension section 20*b*.

Summarizing the above, the unique interconnection between the fly section 26 and jib section 28 allows the center line of the two sections to be coincident with each other when the jib section is in an end-to-end usuable position on the fly section. However, if the jib section is not needed, it is only necessary to remove cable means 60 and pivot the jib section to a stored position, which can be accomplished in a matter of minutes. The jib section, of course, can readily be secured to the fly section in the stored position through suitable interconnecting means (not shown).

Figure 7:
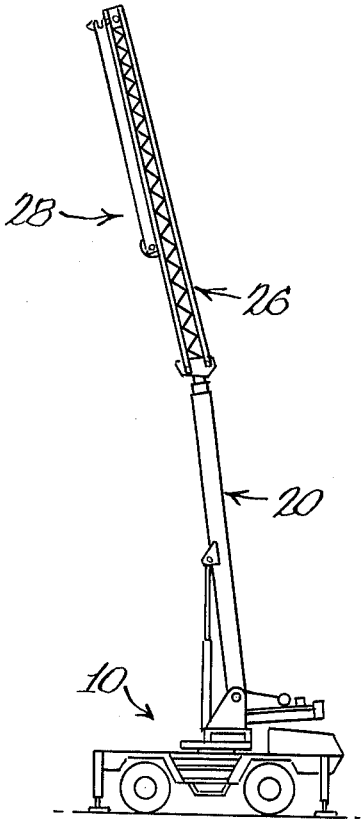
FIG. 7 is a view similar to FIG. 1 showing the jib section in a stored position and the fly section in an angular usable position on the boom.

With the jib in a stored position, fly section 26 can be positioned to any number of angularly related positions with respect to booms 20, one of which is shown in FIG. 7, and the number of positions is dependent upon the number of lower sleeves 116, 118. If the jib section 28 is to be moved to a usable position, fly section 26 must be in direct end-to-end relation with respect to boom 20 before cable means 60 can be secured thereto.

As can be appreciated from the above description, the present invention provides a unique simple arrangement for having the longitudinal axis of the fly and jib sections coincident with each other particularly at the adjacent end when the jib section is in a usable position. In addition, an extremely simple mechanism prevents connection of the jib section in a usable position when fly section 26 is angularly related to boom 20.

What is claimed is:

1. A crane structure comprising a base, a main boom pivotally mounted on said base, a fly section secured to a free end of said main boom, said main boom having an opening adjacent the free end, and a jib section carried by an outer end of said fly section, means mounting said jib section for movement between a usable position in alignment with said fly section and a stored position below said fly section, said mounting means including link means having one end freely pivoted on said fly section and an opposite end pivotally supported on said jib section at a point spaced from a longitudinal center axis thereof, cable means for supporting said jib section, said cable means having one end connected to a free end of said jib section and a member on an opposite end receivable into said opening on said main boom so that the longitudinal axes for said fly section and said jib section are located on a common axis when said jib section is in an end-to-end usable position on said fly section, pivot means connecting said fly section to said main boom to be fixed in a plurality of working positions one of which is in said end-to-end usable position and means preventing insertion of said member into said opening in said main boom when said fly section is in any position other than said end-to-end usable position.

2. A crane structure as defined in claim 1, in which said cable means includes a strut pivotally supported on an inner end of said jib section, a first cable having one end connected to said free end of said main boom and an opposite end connected to said strut and a second cable having one end connected to said strut and an opposite end connected to said free end of said jib section.

3. A crane structure as defined in claim 1, in which said main boom has an opening receiving a pin for connecting said first cable thereto and in which said means preventing connection includes a lug on said fly section, said lug precluding insertion of said pin in said opening when said main boom and said fly sections are angularly related.

4. A crane structure as defined in claim 1, in which said link means includes a link having one end freely pivoted on said longitudinal axis of said fly section and on opposite end freely pivoted on said jib section.

5. A crane structure comprising a base, a main boom pivotally mounted on said base, a fly section secured to a free end of said main boom, and a jib section carried by an outer end of said fly section, means mounting said jib section for movement between a usable position in alignment with said fly section and a stored position below said fly section, a pin on the longitudinal axis of said fly section at the outer end thereof with a sheave supported on said pin, said mounting means including link means including a link having one end freely pivoted on said pin and an opposite end freely pivoted on said jib section at a point spaced from a longitudinal center axis thereof, and cable means having one end connected to a free end of said jib section and an opposite end connected to at least one of said main boom and said fly sections so that the longitudinal axes for said fly section and said jib section are located on a common axis when said jib section is in an end-to-end usable position on said fly section, pivot means connecting said fly section to said main boom and means preventing connection of said first cable to said main boom when the longitudinal axis of said fly section is angularly related to the longitudinal axis of said main boom.

6. A crane structure as defined in claim 5, in which said jib section has a bifurcated end for receiving said pin when said jib section is in a usable position.

7. A crane structure as defined in claim 1, in which said cable means includes means for holding said jib section in at least one angular position on said fly section.

8. A crane structure as defined in claim 1, in which said free end of said main boom has a mounting head having a first opening and said fly section has a first pin supported in said first opening, said mounting head having a plurality of second openings spaced from each other and located on a common radius with respect to said first opening, said fly section having a second pin spaced from said first pin by said radius so that said pin can be inserted into any one of said second openings to support said fly section in a plurality of angularly related positions on said boom.

9. A fly and jib assembly adapted to be attached to a boom comprising a fly section, said fly section having a pin at one end thereof located on a longitudinal center thereof, a sheave supported on said pin, a jib section carried by said one end of said fly section, link means between said one end of said fly section and an adjacent end of said jib section, said link means including at least one link having one end freely pivoted on said pin and an opposite end freely pivoted on said adjacent end of said jib section, so that said jib section can be pivoted from a stored position extending generally along one side and parallel to said fly section to a usable position in generally end-to-end relation with said fly section, said adjacent end of said jib section engaging and being supported by said pin in said usable position.

10. A fly and jib assembly as defined in claim 9, in which said one end of said link is pivotally supported on said pin and in which a longitudinal pivot axis for said jib section is coincident with said longitudinal axis of said fly section when said jib section is in end-to-end relation with said fly section.

11. A crane structure as defined in claim 9, further including cable means having one end connected to a free end of said jib section and an opposite end connected adjacent an opposite end of said fly section for maintaining said jib section in said usable position on said fly section.

12. A crane structure as defined in claim 11, in which said adjacent end of said jib section is bifurcated to receive said pin.

* * * * *